US008159438B2

(12) United States Patent
Nakajima et al.

(10) Patent No.: US 8,159,438 B2
(45) Date of Patent: Apr. 17, 2012

(54) LIQUID CRYSTAL DISPLAY DEVICE, DRIVE METHOD THEREOF, AND MOBILE TERMINAL

(75) Inventors: Yoshiharu Nakajima, Kanagawa (JP); Masaki Murase, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/482,259

(22) PCT Filed: Apr. 28, 2003

(86) PCT No.: PCT/JP03/05466

§ 371 (c)(1),
(2), (4) Date: Dec. 23, 2003

(87) PCT Pub. No.: WO03/094141

PCT Pub. Date: Nov. 13, 2003

(65) Prior Publication Data

US 2004/0160404 A1 Aug. 19, 2004

(30) Foreign Application Priority Data

Apr. 30, 2002 (JP) ..... P2002-127857

(51) Int. Cl.
*G09G 3/36* (2006.01)

(52) U.S. Cl. ..... 345/94; 345/208

(58) Field of Classification Search ..... 345/87, 345/98–101, 94, 96, 208–210
See application file for complete search history.

(56) References Cited

U.S. PATENT DOCUMENTS

| | | | | |
|---|---|---|---|---|
| 5,426,447 | A * | 6/1995 | Lee | 345/103 |
| 5,748,165 | A * | 5/1998 | Kubota et al. | 345/96 |
| 6,556,265 | B1 * | 4/2003 | Murade | 349/111 |
| 6,753,835 | B1 * | 6/2004 | Sakai | 345/87 |
| 6,778,158 | B2 * | 8/2004 | Sun | 345/87 |
| 6,784,862 | B2 * | 8/2004 | Kodate et al. | 345/92 |
| 6,873,313 | B2 * | 3/2005 | Washio et al. | 345/100 |
| 7,038,673 | B2 * | 5/2006 | Lee et al. | 345/211 |
| 2001/0011983 | A1 | 8/2001 | Shiraki et al. | |
| 2001/0033261 | A1 * | 10/2001 | Washio et al. | 345/87 |
| 2002/0075249 | A1 * | 6/2002 | Kubota et al. | 345/204 |

FOREIGN PATENT DOCUMENTS

| | | |
|---|---|---|
| JP | 63-219280 | 9/1988 |
| JP | 63-219280 A | 9/1988 |
| JP | 02-157814 | 6/1990 |
| JP | 02-157814 A | 6/1990 |
| JP | 02-204718 | 8/1990 |
| JP | 04-052684 | 2/1992 |
| JP | 05-94158 A | 4/1993 |
| JP | 06-011731 | 1/1994 |
| JP | 09-33891 A | 2/1997 |
| JP | 09-054309 | 2/1997 |

(Continued)

*Primary Examiner* — Stephen Sherman
(74) *Attorney, Agent, or Firm* — Robert J. Depke; Rockey, Depke & Lyons, LLC

(57) ABSTRACT

Liquid crystal display devices to suffer from low contrast at low temperatures because the frequency characteristics of the liquid crystal dielectric constant are degraded. An active matrix liquid crystal display device performs pre-charging in which a pre-charge signal Psig is written with a pre-charge switch before display signals are written to data lines of a display area with a dated driver. The pre-charge signal Psig is the gray-scale level as obtained when no voltage is applied to liquid crystal, such as a common voltage VCOM, thus increasing the contrast at low temperature.

20 Claims, 4 Drawing Sheets

FOREIGN PATENT DOCUMENTS

| | | | |
|---|---|---|---|
| JP | 09-90908 | A | 4/1997 |
| JP | 11-52931 | A | 2/1999 |
| JP | 11-085115 | | 3/1999 |
| JP | 11-85115 | A | 3/1999 |
| JP | 11-231845 | | 8/1999 |
| JP | 11-231845 | A | 8/1999 |
| JP | 11-311771 | | 11/1999 |
| JP | 2000-112440 | | 4/2000 |
| JP | 2000-112440 | A | 4/2000 |
| JP | 2000-122619 | A | 4/2000 |
| JP | 2000-162577 | | 6/2000 |
| JP | 2000-162577 | A | 6/2000 |
| JP | 2000-304796 | A | 11/2000 |
| JP | 2001-249647 | A | 9/2001 |

* cited by examiner

LIQUID CRYSTAL DISPLAY DEVICE, DRIVE METHOD THEREOF, AND MOBILE TERMINAL

This application claims priority to Japanese Patent Application Number JP2002-127857, filed Apr. 30, 2002 which is incorporated herein by reference.

TECHNICAL FIELD

The present invention relates to a liquid crystal display device, a method for driving the same, and a portable terminal. In particular, the present invention relates to an active matrix liquid crystal display device using a pre-charge system, a method for driving the same, and a portable terminal having such a liquid crystal display device at an output display section.

BACKGROUND ART

Portable terminals such as portable telephones have become increasingly popular in recent years. Such portable terminals typically use a liquid crystal display device for an output display section. These portable terminals are frequently used outdoors, and therefore, are required to ensure stable operation over a wide temperature range. The lower limit of the guaranteed operating temperature range is set to an extremely low level such as about −30° C.

At low temperature, a liquid crystal display device is disadvantageous in that the frequency characteristics of the liquid crystal dielectric constant are degraded, causing the contrast at low temperature to become low. In more detail, referring to FIG. 3 showing an equivalent circuit for a unit pixel, the resistance component R of the liquid crystal material increases at low temperature, thus preventing the pixel electrode, with a liquid crystal capacitance Clc, from being sufficiently charged within a predetermined period of time. Consequently, a desired signal voltage cannot be written to the pixel, causing the contrast to become low.

This problem of low contrast at low temperature is notable particularly in a liquid crystal display device operated at a low voltage to reduce power consumption, in which a lower voltage is applied to the liquid crystal capacitance Clc. In order to overcome the problem described above, a higher voltage may be applied to the liquid crystal capacitance Clc; however, this approach produces another problem in that the output circuit of the data driver for driving the data lines requires a high current capacity, thus consuming more power and occupying a larger circuit area.

A selector drive system, employed in a color liquid crystal display device, is a well-known system that allows three color signals corresponding to three horizontally arranged colors to be time-sequentially sampled within one horizontal period and then written to the data lines in the display area, thus reducing the number of outputs of the data driver to one-third. In such a liquid crystal display device employing the selector drive system, three color signals are sequentially sampled within one horizontal period, and therefore, a shorter period of time is allocated, in particular, for the third sampled color. This problem is more noticeable at low temperature for the reasons described above. Thus, a desired signal voltage cannot be written to the pixel of the third sampled color. As a result, the contrast of the third sampled color becomes significantly low, causing a chromaticity shift (chromaticity deterioration).

In view of the above-described problem, it is an object of the present invention to provide a liquid crystal display device that increases the contrast characteristics at low temperature while still suppressing power consumption and that reduces a chromaticity shift if the selector drive system is employed; a method for driving such a liquid crystal display device; and a portable terminal having such a liquid crystal display device at an output display section.

DISCLOSURE OF INVENTION

In order to achieve the object described above, according to the present invention, a pre-charge signal level is written to each data line in the display area before the display signal is written to each data line, that is, the pre-charge signal level which is equivalent to the gray-scale level as obtained when no voltage is applied to the liquid crystal. The gray-scale level as obtained when no voltage is applied to the liquid crystal is the white level for normally-white liquid crystal display devices or the black level for normally-black liquid crystal display devices.

In the liquid crystal display device, the resistance component of the liquid crystal material increases at low temperature to degrade the frequency characteristics of the liquid crystal dielectric constant. This results in failure to write a desired signal voltage to the pixel electrode with a liquid crystal capacitance within a predetermined period of time. To overcome the abovementioned problem, a liquid crystal display device according to the present invention writes the gray-scale level as obtained when no voltage is applied to the liquid crystal to the data lines, prior to writing display signals to the data lines, where the gray-scale level functions as a pre-charge signal level. Thus, driving of the data lines can be started with the gray-scale signal level; in other words, a desired signal voltage can be written to the data lines within a shorter period of time. For the reason described above, even if the frequency characteristics of the liquid crystal dielectric constant are degraded at low temperature, a desired signal voltage can be written to the pixel electrode with a liquid crystal capacitance within a predetermined period of time, thereby increasing the contrast at low temperature.

BEST MODE FOR CARRYING OUT THE INVENTION

Figure 1:
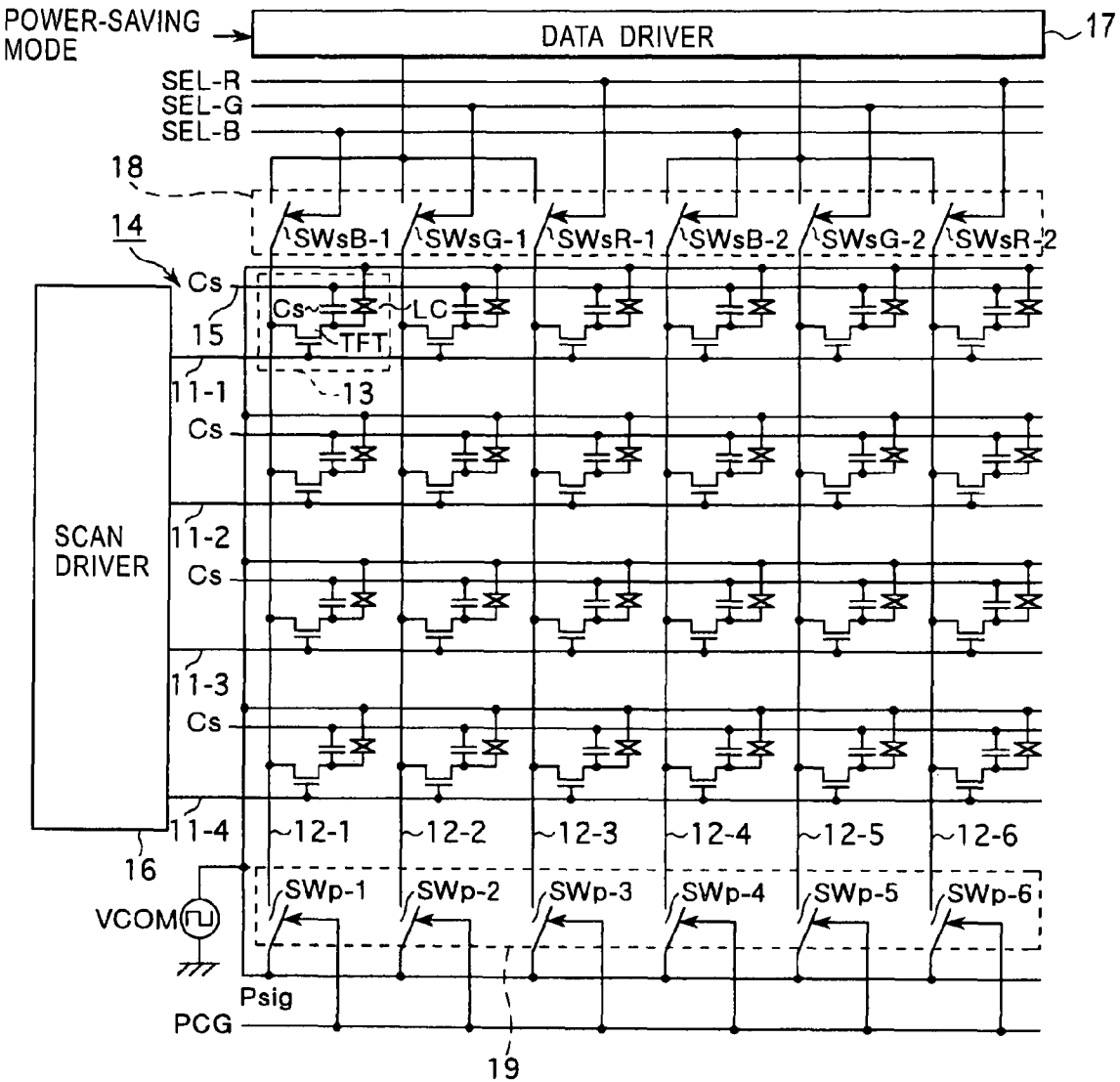
FIG. 1 is a circuit diagram of an active matrix liquid crystal display device according to an embodiment of the present invention.

Embodiments according to the present invention will now be described in detail with reference to the attached drawings. FIG. 1 is a circuit diagram of an active matrix liquid crystal display device according to an embodiment of the present invention. For convenience, the embodiment will be described by way of an example in which a pixel array has four rows by six columns.

Referring to FIG. 1, gate lines 11-1 to 11-4 and data lines 12-1 to 12-6 are wired in a matrix. A pixel 13 is formed at each of the intersections of the gate lines and data lines described above, all the pixels 13 together thus forming a display area 14. Each of the pixels 13 includes a pixel transistor TFT (thin film transistor) having its gate electrode connected to the corresponding gate line (one of the gate lines 11-1 to 11-4) and its source electrode (or drain electrode) connected to the corresponding data line (one of the data lines 12-1 to 12-6); a liquid crystal cell LC whose pixel electrode is connected to the drain electrode (or source electrode) of the pixel transistor TFT; and a storage capacitor Cs connected in parallel with the liquid crystal cell LC.

In the pixel structure described above, the counter electrodes of the liquid crystal cells LC are commonly connected among all pixels. A common voltage VCOM is applied to the counter electrodes of the liquid crystal cells LC. For 1H (H represents a horizontal period) reverse driving or 1F (F represents a period equivalent to one field) reverse driving described below, the display signals to be written to the data lines 12-1 to 12-6 are polarity-reversed with respect to this common voltage VCOM.

In the liquid crystal display device according to the embodiment, VCOM reverse driving is also employed in which the common voltage VCOM is polarity-reversed every 1H period or 1F period. When this VCOM reverse driving is used together with 1H reverse driving or 1F reverse driving, the operating power voltage of the output circuit of the data driver described below can be half of that when VCOM reverse driving is not used, thus allowing the data driver to be operated at a lower voltage.

The common voltage VCOM is supplied as an alternate voltage with an amplitude substantially equal to that of the display signals used: 0 to 3.3 V, for example. When signals are written to the pixel electrodes of the liquid crystal cells LC through the pixel transistors TFT from the data lines 12-1 to 12-6, factors such as parasitic capacitance cause a voltage drop at the pixel transistors TFT. For this reason, in practice, an alternate voltage with an amplitude shifted by the voltage drop is practically used for the common voltage VCOM. Along with this VCOM reverse driving, a voltage which has the same amplitude as the common voltage VCOM and which is polarity-reversed in synchronization with the common voltage VCOM is applied to the electrodes of the storage capacitors Cs adjacent to the counter electrodes via the Cs lines 15 (the adjacent lines to the counter electrodes).

A scan driver 16 serving as vertical driving means is disposed, for example, to the left of the display area 14. The scan driver 16 sequentially drives the gate lines 11-1 to 11-4 every one field period to select each row of pixels 13 at a time. A data driver 17 is disposed, for example, above the display area 14. A selector switch 18 is disposed between the data driver 17 and the display area 14. A pre-charge switch 19 is disposed, for example, below the display area 14.

The data driver 17 repeatedly outputs the display signals for the three colors, that is, blue (B), green (G), and red (R), in a predetermined order such as B, G, and R. In this case, the display signals are output for each group of three columns of the pixel array in the display area 14. This repetition period is usually the 1H period. In short, each of the B, G, and R signals is time-sequentially output within the 1H period. At this time, the polarities of these color signals are reversed every 1H with respect to the common voltage VCOM. In this manner, 1H reverse driving is performed wherein the polarity of the display signal to be applied to each pixel 13 is reversed every 1H.

In a power-saving mode, the data driver 17 repeatedly outputs the B, G, and R color signals every one field period (1F). At this time, the polarities of these color signals are reversed every 1F with respect to the common voltage VCOM. Thus, 1F reverse driving is performed wherein the polarity of the display signal to be applied to each pixel 13 is reversed every 1F. With 1F reverse driving, polarity reversal of the color signals is required much less frequently than with 1H reverse driving, thereby suppressing power consumption of the output circuit of the data driver 17. This means 1F reverse driving is effective in reducing power consumption (that is, contributing to power saving).

As described above, the data driver 17 outputs display signals Sig1, Sig2, and so on. These display signals are each a time-sequence signal of B, G, and R color signal components, and are supplied to the selector switch 18, one for each group of two or more adjacent pixels (three pixels, for example) in the same row of the pixel array in the display area 14. The selector switch 18 enables the selector drive system, where the display signals for the pixels corresponding to the three colors horizontally arranged in the display area 14 are time-sequentially sampled into the data lines 12-1 to 12-6 within one horizontal period.

More specifically, the selector switch 18 has a group of three analog switches SWsB-1, SWsG-1, and SWsR-1 for the display signal Sig1, a group of three analog switches SWsB-2, SWsG-2, and SWsR-2 for the display signal Sig2, and so on. The input terminals of the analog switches in each group are connected to one common line. The output terminals of the analog switches are connected to the respective data lines 12-1 to 12-6 in the display area 14.

In the selector switch 18, the analog switches for the same color are turned ON/OFF in synchronization with the corresponding external select pulse SEL-B, SEL-G, or SEL-R applied time-sequentially. More specifically, the analog switches SWsB-1 and SWsB-2 are turned ON/OFF in synchronization with the select pulse SEL-B for color B, the analog switches SWsG-1 and SWsG-2 are turned ON/OFF in synchronization with the select pulse SEL-G for color G, and the analog switches SWsR-1 and SWsR-2 are turned ON/OFF in synchronization with the select pulse SEL-R for color R.

The selector drive system achieved with this selector switch 18 allows the display signals Sig1 and Sig2 for the pixels arranged horizontally in each row to be time-sequentially sampled and supplied to the data lines 12-1 to 12-6 in the display area 14 within one horizontal period, and hence is advantageous in that it allows the number of outputs from the dated driver 17 to be reduced to one-third of the number of data lines 12-1 to 12-6 in the display area 14.

The pre-charge switch 19 is used for the pre-charge system, where a pre-charge signal Psig is written to the data lines 12-1 to 12-6 just before writing to the data lines 12-1 to 12-6 the display signals Sig1 and Sig2 sampled using the selector switch 18.

In more detail, the pre-charge switch 19 includes as many analog switches (SWp-1 to SWp-6) as the number of columns of the pixel array in the display area 14. One end of each of these analog switches SWp-1 to SWp-6 is connected to one common line serving as the input terminal of the pre-charge signal Psig, whereas the other end of each of the same analog switches is connected to the corresponding data line, that is, one of the data lines 12-1 to 12-6 in the display area 14. The analog switches SWp-1 to SWp-6 are turned ON/OFF in synchronization with the pre-charge pulse PCG, which is applied externally prior to the first select pulse SEL-B.

Now, let us see what happens if pre-charging is not performed in a liquid crystal display device employing the analog point-at-a-time driving system. If the pre-charge signal Psig is not written to the data lines 12-1 to 12-6 in such a liquid crystal panel before the display signals Sig1 and Sig2 are written, a large charge/discharge current resulting from signals being written to the data lines 12-1 to 12-6 during 1H reverse driving described above generates noise, such as vertical streaks, on the display screen. On the other hand, writing the pre-charge signal Psig (typically gray or black level for a normally-white liquid crystal panel) to the data lines 12-1 to 12-6 suppresses a charge/discharge current caused by signal writing, thereby reducing noise.

Unfortunately, pre-charging of a signal similar to the pre-charge signal Psig for improving the low temperature characteristics leads to an increase in power consumption. In order to suppress power consumption caused by this pre-charging, the liquid crystal display device according to the embodiment uses the pre-charge signal Psig which is the gray-scale level as obtained when no voltage is applied to the liquid crystal, that is, the gray-scale level equivalent to the white level for a normally-white liquid crystal display device or the black level for a normally-black liquid crystal display device. More specifically, the common voltage VCOM is equivalent to the gray-scale level as obtained when no voltage is applied to the liquid crystal, i.e., the white-level for a normally-white liquid crystal display device, for example. The liquid crystal display device according to the embodiment, therefore, uses the common voltage VCOM for the pre-charge signal Psig.

As described above, the active matrix liquid crystal display device employing the pre-charge system may allocate the gray-scale level as obtained when no voltage is applied to the liquid crystal, such as the common voltage VCOM, for the pre-charge signal Psig; turn ON/OFF the pre-charge switch 19 in synchronization with the pre-charge pulse PCG just before sampling, with the selector switch 18, the desired display signals Sig1, Sig2, and so on supplied from the data driver 17 to pre-charge the data lines 12-1 to 12-6 with the common voltage VCOM; and then sequentially turn ON/OFF the selector switch 18 in synchronization with the select pulses SEL-B, SEL-G, and SEL-R to write the desired signal into the corresponding pixel 13 through the data lines 12-1 to 12-6. The advantages of these features will become apparent in the following description.

Figure 2:
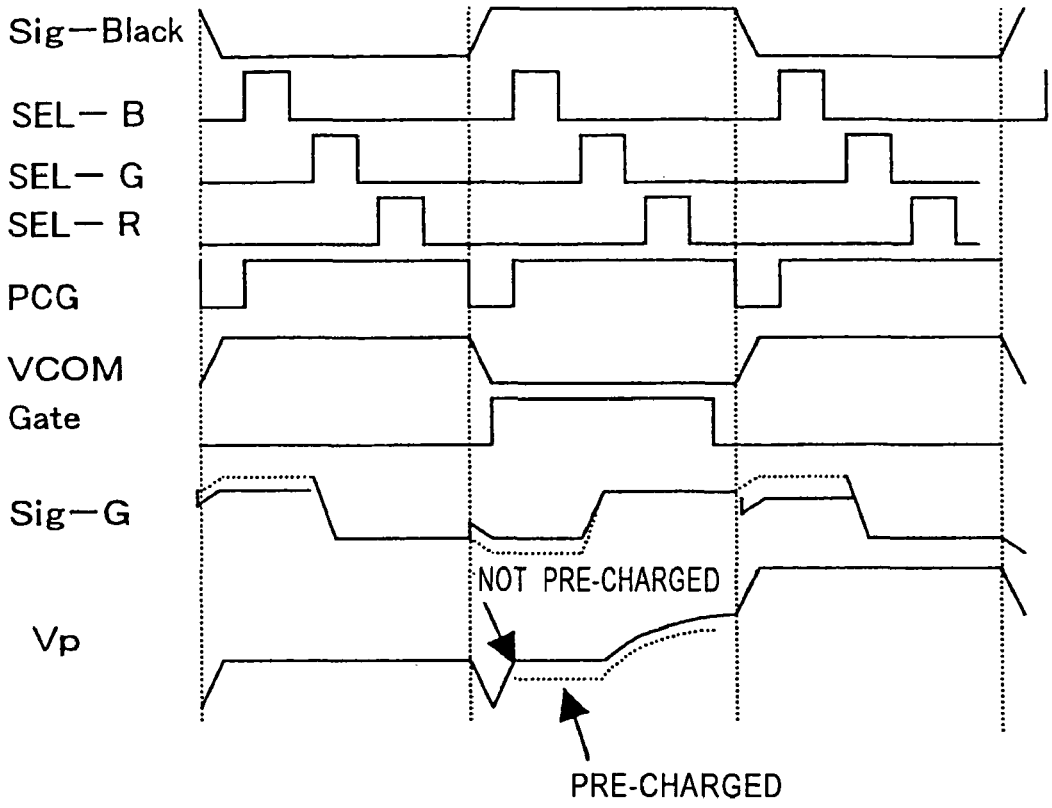
FIG. 2 is a timing chart illustrating the timing of writing a black signal to a G pixel when the B, G, and R signals are sampled in that order in a normally-white liquid crystal display device.

FIG. 2 illustrates the timing of writing the black signal to a G pixel when the B, G, and R signals are sampled in that order in a liquid crystal display device such as a normally-white liquid crystal display device. For VCOM reverse driving, the common voltage VCOM has a phase-reversed relationship with the output signals Sig from the data driver 17.

Figure 3:
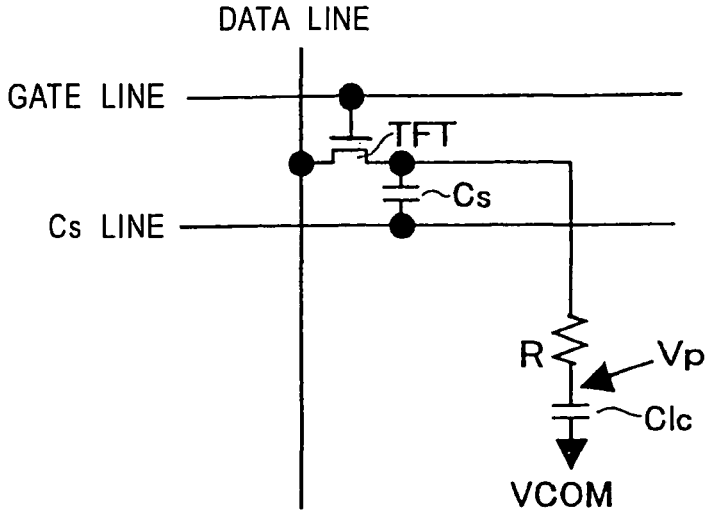
FIG. 3 is a circuit diagram showing an equivalent circuit for a unit pixel.

Without pre-charging, the potential Sig-G of the data line for G before being written, as shown by the dotted lines in FIG. 2, drops from the original voltage level: that is, it is adversely affected by this phase-reversed common voltage VCOM. Referring now to FIG. 3 showing an equivalent circuit for a unit pixel, the potential Vp of the pixel electrode with the liquid crystal capacitance Clc also drops, as shown by the dotted lines in FIG. 2. An increase in the resistance component R of the liquid crystal material at low temperature prevents a desired signal voltage from being sufficiently written to the pixel within a predetermined period of time, thus causing a low contrast.

In contrast, pre-charging the data lines of the pre-charge pulse PCG (active at the low level) with the gray-scale signal as obtained when no voltage is applied to the liquid crystal, i.e., the common voltage VCOM in the embodiment serving as the pre-charge signal Psig, prior to writing the black signal, causes the potential Sig-G of the data line for G to come to the middle level, as shown by the solid line in FIG. 2, thus causing the potential Vp of the pixel electrode with the liquid crystal capacitance Clc to come to the middle level. Thereafter, the selector pulse SEL-G for G turns ON the selector switch SWsG, thus allowing the signal Sig-G to rise from the middle level. Hence, despite an increase in the resistance component R of the liquid crystal material at low temperature, the pixel electrode with the liquid crystal capacitance Clc can be charged sufficiently within a predetermined period of time and a desired signal voltage can be written to the pixel, thus increasing the contrast even at low temperature.

Another disadvantage without pre-charging is that, as shown by the dotted lines in FIG. 2, the potential Vp of the pixel electrode with the liquid crystal capacitance Clc cannot reach the desired signal level within a predetermined period of time. This disadvantage is noticeable, particularly with the signal for R, which is sampled last during B, G, and R sampling in that order. Thus, the contrast for R is greatly degraded at low temperature. On the other hand, pre-charging as described above brings the potential Vp of the pixel electrode with the liquid crystal capacitance Cls to the middle level, and thereby the potential Vp of the pixel electrode with the liquid crystal capacitance Cls can reach the desired signal level well within a predetermined period of time. Consequently, a chromaticity shift at low temperature can be greatly reduced.

In the embodiment described above, the common voltage VCOM applied to the counter electrodes of the liquid crystal cells LC is used for the gray-scale level as obtained when no voltage is applied to the liquid crystal. A reference voltage other than the common voltage VCOM can also be used: a voltage applied to the electrodes of the storage capacitors Cs adjacent to the Cs lines, for example. This voltage has a level substantially equivalent to that of the common voltage VCOM and can be used for the gray-scale level as obtained when no voltage is applied to the liquid crystal, namely, the pre-charge signal Psig.

If a voltage applied to the electrodes of the storage capacitors Cs adjacent to the Cs lines is used for the pre-charge signal Psig, the Cs driver (not shown in the figures) for driving the Cs lines 15 can be used for the pre-charge switch (pre-charge driver) 19. In this case, the Cs driver can normally be composed of a CMOS inverter, and therefore does not allow much direct current to flow in the circuit thereof. Pre-charging is also advantageous in that the pre-charge driver (Cs driver) accounts for half the charging/discharging required in the output circuit (analog circuit) of the data driver 17, thus reducing the current consumption in the output circuit. This advantage greatly contributes to the low power-consumption design of the liquid crystal display device.

The forgoing embodiment has been described with reference to, but not limited to, a liquid crystal display device employing the VCOM reverse driving system. In other words, the present invention is not limited to VCOM reverse driving but is also applicable to a common voltage VCOM fixed to a particular DC voltage. In this case, the voltage applied to the electrodes of the storage capacitors Cs adjacent to the Cs lines, that is, the potential of the Cs lines 15, is also fixed to the common voltage VCOM or another DC level.

The embodiment described above has been described by way of an example of a liquid crystal display device employing the selector drive system. The present invention is also applicable to techniques other than the selector drive system. Some of these other techniques are the line-at-a-time driving system, in which the display signals for each row of pixels in the display area 14 are sampled all at once within one horizontal period to supply the display signals to the data lines, and the point-at-a-time driving system, in which the display signals for each row of pixels in the display area 14 are sequentially sampled within one horizontal period to supply the display signals to the data lines. If the present invention is applied particularly to the point-at-a-time driving system, the period of time for writing the signal for the pixel to be sampled last is reduced, thus exhibiting an advantage in that shading at low temperature is reduced.

Figure 4:
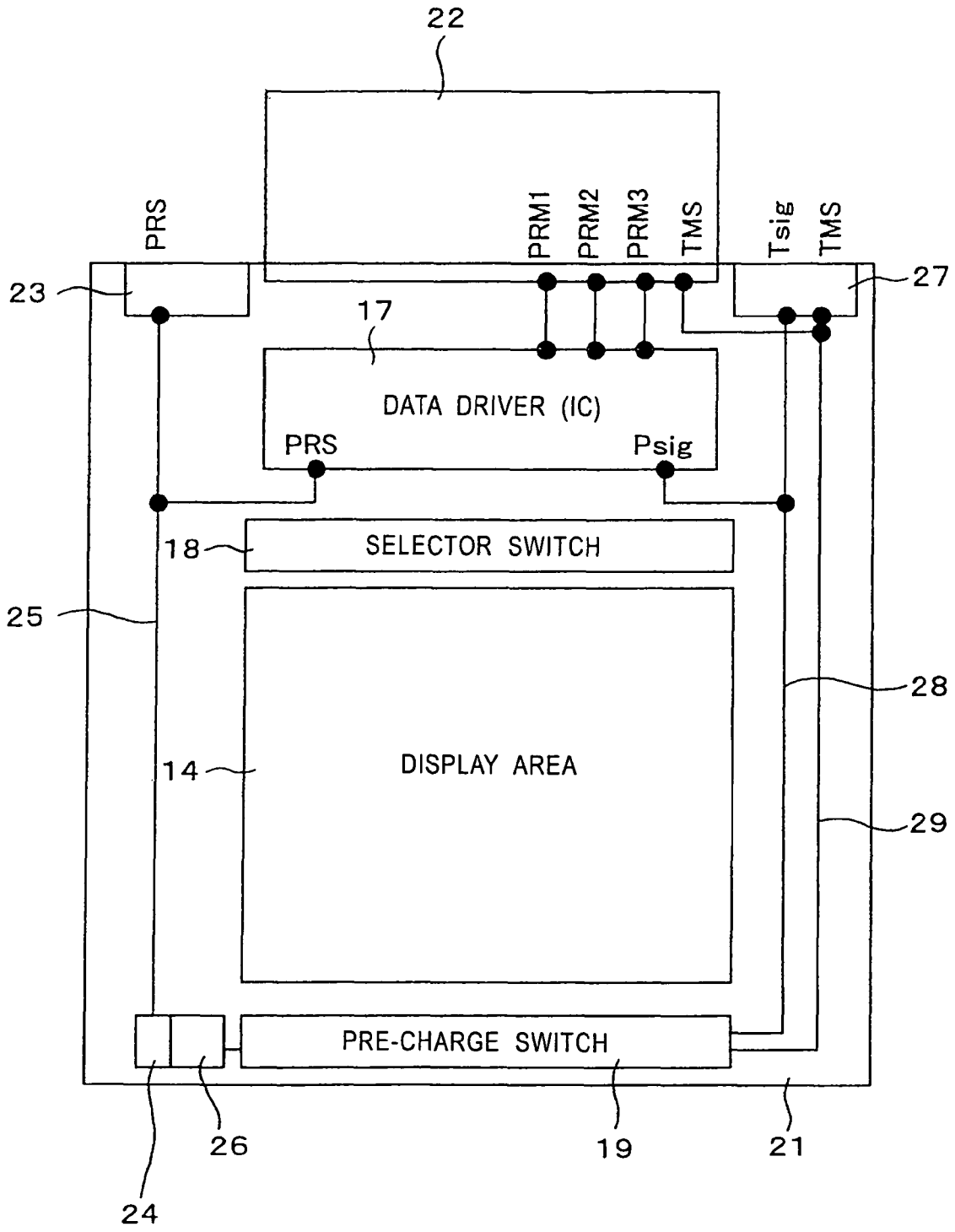
FIG. 4 is a block diagram illustrating a typical structure of a liquid crystal panel according to an embodiment of the present invention.

FIG. 4 is a block diagram illustrating a typical structure of the liquid crystal panel according to the embodiment described above. The same symbols in FIG. 4 as those in FIG. 1 refer to the same components.

In the above structure, the data driver 17 is implemented as an IC on a glass substrate 21 by COG (Chip On Glass). The positional relationships among the display area 14, the data driver 17, the selector switch 18, and the pre-charge switch 19 on the glass substrate 21 are same as in FIG. 1. In FIG. 4, however, the scan driver 16 is not shown. The data driver 17 receives external setting signals PRM1, 2, and 3 via a flexible printed circuit board 22, where the setting signals PRM1, 2, and 3 determine how a control signal PRS described below is output.

In a 1F reverse driving mode or during non-display period in a partial mode, the data driver 17 outputs the control signal PRS that defines whether or not to make the pre-charge switch 19 active during the horizontal blanking interval. The data driver 17 further outputs the gray-scale signal as obtained when no voltage is applied to the liquid crystal, namely, the gray-scale signal serving as the pre-charge signal Psig. For this gray-scale signal as obtained when no voltage is applied to the liquid crystal, the common voltage VCOM is used in the embodiment described above.

The output terminal for the control signal PRS on the data driver 17, the PRS terminal on the test pad 23, and a level shift circuit 24 on the glass substrate 21 are electrically connected to one another by wiring 25. The control signal PRS output from the data driver 17 is supplied to the level shift circuit 24 through the wiring 25.

The level shift circuit 24 shifts the control signal PRS from a first voltage level, such as 3.3 V, to a higher second voltage level, such as 7.0 V. The control signal PRS which has undergone level shift is given to a pulse generating circuit 26 for generating the pre-charge pulse PCG to control whether or not to generate the pre-charge pulse PCG. The pre-charge pulse PCG generated by the pulse generating circuit 26 is given to the pre-charge switch 19.

The output terminal for the pre-charge signal Psig on the data driver 17, the Tsig terminal on a test pad 27, and the pre-charge switch 19 are electrically connected to one another by wiring 28. The pre-charge signal Psig output from the data driver 17 is supplied to the pre-charge switch 19 via the wiring 28.

Furthermore, the TMS terminal of the flexible printed circuit board 22, the TMS terminal of the test pad 27, and the pre-charge switch 19 are electrically connected to one another by wiring 29. An external control signal TMS is input to the TMS terminal of the flexible printed circuit board 22 and is supplied to the pre-charge switch 19 via the wiring 29. This control signal TMS sets the pre-charge switch 19 to a test mode or a pre-charge driving mode.

In the liquid crystal display device according to the embodiment having the structure described above, setting the pre-charge switch 19 to the test mode using the control signal TMS input via the TMS terminal of the flexible printed circuit board 22 causes a test signal Tsig to be input via the Tsig terminal on the test pad 27 and to be given to the pre-charge switch 19 via the wiring 28, thus allowing a panel display test to be performed without the driver IC (data driver 17). In this case, the pre-charge switch 19 functions as a test switch.

With the data driver 17 implemented, the control signal PRS output from the data driver 17 makes the pre-charge switch 19 active during the horizontal blanking interval, thus allowing pre-charging, where the pre-charge switch 19 writes the pre-charge signal Psig before the data driver 17 writes the signal to the data line for each pixel in the display area 14, as described in the foregoing embodiment.

On the other hand, in the 1F driving reverse mode or during the non-display period in the partial mode, the control signal PRS output from the data driver 17 makes the pre-charge switch 19 inactive during the horizontal blanking interval, thus disabling pre-charging in the 1F reverse driving mode or during the non-display period in the partial mode. This approach further reduces power consumption in the liquid crystal display device.

In more detail, the 1F reverse driving mode can allocate a longer period of time for writing signals to pixels, and hence suffers from less low contrast at low temperature than with the 1H reverse driving mode. This advantage of the 1F reverse driving mode allows pre-charging to be disabled, thus contributing to a reduction in power consumption by as much as the power required for driving the pre-charge switch 19.

During the non-display period in the partial mode for a normally-white liquid crystal display device, for example, the white signal is written to the data lines so that the non-display area appears white. This operation is equivalent to writing the common voltage VCOM serving as the pre-charge signal Psig to the data lines, eliminating the need for pre-charging. This also allows pre-charging to be disabled to reduce power consumption.

Figure 5:
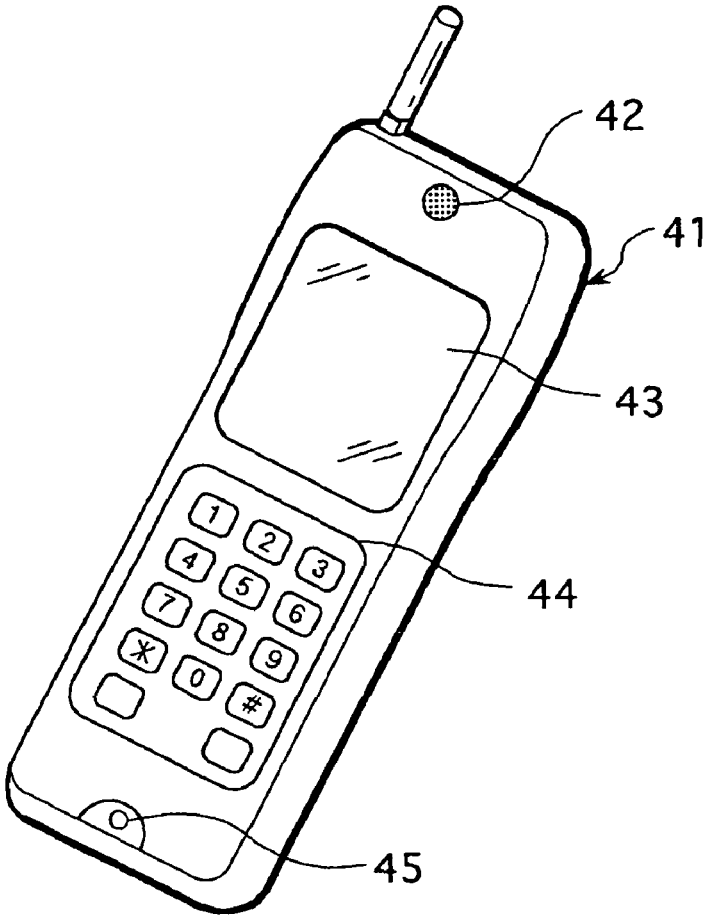
FIG. 5 is a schematic drawing illustrating the outline of a portable telephone according to the present invention.

FIG. 5 is a schematic drawing illustrating the outline of a portable terminal such as a portable telephone according to the present invention.

The portable telephone according to the embodiment includes a speaker section 42, an output display section 43, an operating section 44, and a microphone section 45 in that order from top to bottom of the front surface of a device casing 41. In the portable telephone structured as described above, the liquid crystal display device according to the foregoing embodiment or the example is used at the output display section 43.

Figure 6:
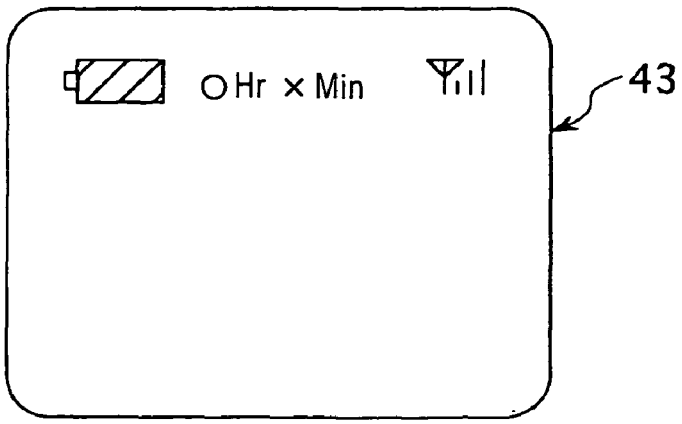
FIG. 6 shows a typical appearance of an output display section.

The output display section 43 of such a portable telephone is provided with a partial display mode: a display function in a standby mode in which images are displayed in part of the screen in the vertical direction. In the standby mode, for example, information about the remaining battery power, receiver sensitivity, or time is always displayed in part of the screen, as shown in FIG. 6. The non-display area other than the display area appears white for a normally-white liquid crystal display device or black for a normally-black liquid crystal display device.

Thus, the portable telephone provided with the output display section 43, i.e., the liquid crystal display device according to the foregoing embodiment or modification may perform pre-charging prior to writing the display signals to the pixels in order to enhance the contrast characteristics over a wide guaranteed operating temperature range, particularly at low temperature, thereby exhibiting superior image display in an environment at any temperature.

Another advantage is that pre-charging is disabled in the non-display area for partial display in the standby mode to reduce power consumption in the output display section 43 by as much power as consumed by the pre-charge driver, thus allowing long-term operation with one battery charge of the main power supply.

The foregoing embodiment has been described by way of an example of a portable telephone, but not limited to this. The present invention is applicable to other portable terminals such as PDA (personal digital assistants).

Industrial Applicability

As described above, the present invention allows pre-charging before the display signals are written to the pixels, where the pre-charge signal is the gray-scale level as obtained when no voltage is applied to the liquid crystal to ensure that a desired signal voltage is written to the pixel despite the increased resistance component of the liquid crystal material at low temperature, thus enhancing the contrast characteristics at low temperature while still suppressing power consumption.

The invention claimed is:

1. A liquid crystal display device comprising:

a signal writing means for writing display signals to data lines in a display area comprising a matrix of pixels; and a pre-charging means for writing a gray-scale level to the data lines before the signal writing means writes the display signals to the data lines, the gray scale level serving as a pre-charge signal level;

wherein the pre-charge signal is selectively applied to each of the data lines simultaneously and the pre-charge signal is also directly applied to another portion of each pixel as VCOM and wherein the pre-charge signal is altered during each selective application of the pre-charge signal such that the pre-charge signal value that is achieved during the selective application of the pre-charge signal to the data lines is an opposite polarity of a prior value and the pre-charge signal is disconnected from the data lines while the data signals are sequentially applied to the data lines; and further wherein the pre-charge signal is selectively inhibited during 1F driving reverse mode and/or a non-display period in a partial mode.

2. The liquid crystal display device according to claim 1, wherein the signal writing means time-sequentially samples display signals, each corresponding to a group of adjacent pixels in the same row of the display area, during one horizontal period, and supplies the display signals to the data lines, and wherein the pre-charging means writes the pre-charge signal to the data lines before the signal writing means samples the display signals.

3. The liquid crystal display device according to claim 1, wherein the signal writing means sequentially samples display signals corresponding to the pixels in each row of the display area during one horizontal period and supplies the display signals to the data lines, and wherein the pre-chargingmeans writes the pre-charge signal to the data lines before the signal writing means samples the display signals.

4. The liquid crystal display device according to claim 1, wherein the signal writing means simultaneously samples all display signals corresponding to the pixels in each row of the display area during one horizontal period and supplies the display signals to the data lines, and wherein the pre-charging means writes the pre-charge signal to the data lines before the signal writing means samples the display signals.

5. The liquid crystal display device according to claim 1, wherein a liquid crystal cell in each pixel includes a liquid crystal layer positioned between a pixel electrode and a counter electrode, the counter electrode of each pixel in the device being electrically common; and wherein the gray-scale signal is a common voltage applied to the common counter electrodes of the pixels.

6. The liquid crystal display device according, to claim 1, wherein a liquid crystal cell in each pixel includes a liquid crystal layer positioned between a pixel electrode and a counter electrode, the counter electrode of each pixel in the device being electrically common;

wherein the liquid crystal device in each pixel also includes a storage capacitor having a first electrode and having an oppositely formed second electrode, the second electrode connected to the pixel electrode of the liquid crystal cell; and wherein the gray-scale signal is a voltage applied to the first ends of the storage capacitors.

7. The liquid crystal display device according to claim 1, wherein the device utilizes one field reverse driving mode such that the polarity of the display signal to be written to each pixel is reversed during one field period every one field period; and wherein the pre-charging means does not provide the pre-charge signal when one field reverse driving mode is performed.

8. The liquid crystal display device according to claim 1, wherein the device utilizes a partial driving mode that drives only part of the display area; and wherein the pre-charging means does provide the pre-charge signal when a non-display period in the partial mode occurs.

9. The liquid crystal display device according to claim 1, wherein the pre-charging means writes an external test signal to the data lines in place of the pre-charge signal.

10. The liquid crystal display device according to claim 1, wherein said electrical component of one of the pixels is a counter electrode.

11. The liquid crystal display device according to claim 1, wherein said electrical component of one of the pixels is a storage capacitor connected in parallel with a liquid crystal cell, wherein the end of the storage capacitor opposite the end connected to a pixel selection transistor is electrically connected to the data line during pre-charge.

12. A method for driving a liquid crystal display device comprising:

writing a gray-scale level to data lines in a display area comprising a matrix of pixels before writing display signals to the data lines automatically via switching circuitry, the gray-scale level serving as a pre-charge signal level, wherein the gray-scale level is selectively written to each of the data lines simultaneously and the pre-charge signal is also directly applied to another portion of each pixel other than the data line as VCOM;

and wherein the pre-charge signal is altered during each selective application of the pre-charge signal such that the pre-charge signal value that is achieved during the selective application of the pre-charge signal to the data lines is an opposite polarity of a prior value and the pre-charge signal is disconnected from the data lines while the data signals are sequentially applied to the data lines; and further wherein the pre-charge signal is selectively inhibited during 1F driving reverse mode and/or a non-display period in a partial mode.

13. A method of driving a liquid crystal display device according to claim 12, wherein said electrical component of one of the pixels is a counter electrode.

14. A method of driving a liquid crystal display device according to claim 12, wherein said electrical component of one of the pixels is a storage capacitor connected in parallel with a liquid crystal cell, wherein the end of the storage capacitor opposite the end connected to a pixel selection transistor is electrically connected to the data line during pre-charge.

15. A portable terminal including an output display section which is a liquid crystal display device, wherein the liquid crystal display device comprises:

signal writing means for writing display signals to data lines in a display area comprising a matrix of pixels; and pre-charging means for writing a gray-scale level to the data lines before the signal writing means writes the display signals to the data lines, the gray-scale level serving as a pre-charge signal level;

wherein the pre-charge signal is selectively applied to each of the data lines simultaneously and the pre-charge signal is also directly applied to another portion of each pixel other than the data line, and wherein the pre-charge signal is altered during each selective application of the pre-charge signal such that the pre-charge signal value that is achieved during the selective application of the pre-charge signal is an opposite polarity of a prior value and the pre-charge signal is disconnected from the data lines while the data signals are sequentially applied to the data lines; and further wherein the pre-charge signal is selectively inhibited during 1F driving reverse mode and/or a non-disolav period in a partial mode.

16. The portable terminal according to claim 15, wherein the output display section utilizes a partial mode for driving only part of the display area, and wherein the pre-charging means does not perform the pre-charging when a non-display period in the partial mode occurs.

17. The liquid crystal display device according to claim 15, wherein said electrical component of one of the pixels is a counter electrode.

18. The liquid crystal display device according to claim 15, wherein said electrical component of one of the pixels is a storage capacitor connected in parallel with a liquid crystal cell, wherein the end of the storage capacitor opposite the end connected to a pixel selection transistor is electrically connected to the data line during pre-charge.

19. A method for driving a liquid crystal display device comprising:

selectively writing a gray-scale level to data lines in a display area via switching circuitry comprising a matrix of pixels before writing display signals to the data lines, the gray-scale level serving as a pre-charge signal level, and wherein the gray-scale level is selectively written to each of the data lines simultaneously and the pre-charge signal is a signal from a same source which supplies the grey scale level to a plurality of conductive lines which each cross the plurality of data lines at locations corresponding to the pixels and wherein the pre-charge signal is altered during each selective application of the pre-charge signal to the data lines such that the pre-charge signal value that is achieved during the selective application of the pre-charge signal to the data lines is an opposite polarity of a prior value and the pre-charge signal is disconnected from the data lines while the data signals are sequentially applied to the data lines; and further wherein the pre-charge signal is selectively inhibited during 1F driving reverse mode and/or a non-display period in a partial mode.

20. A system for driving a liquid crystal display device comprising:

means for selectively writing a gray-scale level to data lines in a display area comprising a matrix of pixels before writing display signals to the data lines, the gray-scale level serving as a pre-charge signal level, and the pre-charge signal is from a same source which supplies the grey scale level to a plurality of conductive lines which each cross the plurality of data lines at locations corresponding to the pixels, and wherein the pre-charge signal is altered during each selective application of the pre-charge signal such that the pre-charge signal value that is achieved during the selective application of the pre-charge signal to the data lines is an opposite polarity of a prior value and the pre-charge signal is disconnected from the data lines while the data signals are sequentially applied to the data lines; and further wherein the pre-charge signal is selectively inhibited during 1F driving reverse mode and/or a non-display period in a partial mode.

* * * * *